US008988251B2

(12) United States Patent
Clements

(10) Patent No.: US 8,988,251 B2
(45) Date of Patent: Mar. 24, 2015

(54) APPARATUS AND METHOD FOR IMPLEMENTING SAFE VISUAL INFORMATION PROVISION

(75) Inventor: Benjamin Clements, Manchester (GB)

(73) Assignee: Park Signalling Limited, Reddish, Stockport (GB)

( * ) Notice: Subject to any disclaimer, the term of this patent is extended or adjusted under 35 U.S.C. 154(b) by 501 days.

(21) Appl. No.: 13/287,157

(22) Filed: Nov. 2, 2011

(65) Prior Publication Data

US 2012/0280837 A1 Nov. 8, 2012

Related U.S. Application Data

(63) Continuation of application No. PCT/GB2010/000625, filed on Mar. 30, 2010.

(30) Foreign Application Priority Data

May 30, 2009 (GB) ..... 0909373.3

(51) Int. Cl.

| | |
|---|---|
| ***G08G 1/01*** | (2006.01) |
| ***B61L 3/12*** | (2006.01) |
| ***B61L 15/00*** | (2006.01) |
| ***B61L 27/00*** | (2006.01) |

(52) U.S. Cl.

CPC ..... *B61L 3/125* (2013.01); *B61L 15/009* (2013.01); *B61L 27/0038* (2013.01)

USPC ..... 340/933; 340/988; 246/1 C; 246/122 R; 701/19

(58) Field of Classification Search

USPC ..... 340/933, 988, 425.5, 438; 246/14, 246/122 R, 167 R, 62, 1 C, 182 R; 701/19, 701/301

See application file for complete search history.

(56) References Cited

U.S. PATENT DOCUMENTS

| | | | | |
|---|---|---|---|---|
| 6,666,411 | B1 * | 12/2003 | Hart et al. | 246/62 |
| 7,131,614 | B2 * | 11/2006 | Kisak et al. | 246/167 R |
| 7,200,471 | B2 * | 4/2007 | Kane et al. | 701/19 |
| 7,865,279 | B2 * | 1/2011 | Taki | 701/31.4 |
| 2008/0292098 | A1 * | 11/2008 | Akima et al. | 380/28 |
| 2013/0299645 | A1 * | 11/2013 | Cooper et al. | 246/122 R |

FOREIGN PATENT DOCUMENTS

| | | | |
|---|---|---|---|
| EP | 0 257 909 | A2 | 3/1988 |
| EP | 1 769 996 | A2 | 4/2007 |
| EP | 1 942 041 | A2 | 7/2008 |
| WO | WO 96/21590 | | 7/1996 |
| WO | WO 02/064415 | A1 | 8/2002 |
| WO | WO 2006/136783 | A1 | 12/2006 |

* cited by examiner

*Primary Examiner* — Brent Swarthout

(74) *Attorney, Agent, or Firm* — Woodard, Emhardt, Moriarty, McNett & Henry LLP

(57) ABSTRACT

The invention relates to an apparatus and method which allows information representing a state or condition or an action to be performed as part of a control system to be present to one or more users. The information is selected and generated in a manner which removes or at least reduces the risk of potentially catastrophic error occurring which would be possible if, for example, the information is corrupt or lost during subsequent transmission, remote processing and/or displaying. One such use of the apparatus and method of the invention is in relation to transport vehicles and the control of the movement of said vehicles along predefined geographical paths.

37 Claims, 4 Drawing Sheets

APPARATUS AND METHOD FOR IMPLEMENTING SAFE VISUAL INFORMATION PROVISION

REFERENCE TO RELATED APPLICATIONS

This application is a continuation of PCT/GB2010/000625, filed 30 Mar. 2010, which is hereby incorporated by reference. This application claims priority from Patent Application No. GB 0909373.3, filed 30 May 2009, which is hereby incorporated by reference.

The invention to which this application relates is apparatus and a method which allows information representing an action and/or system state or condition to be presented to one or more users and for the information to be selected and generated in a manner which removes or at least reduces the risk of a potentially catastrophic error occurring should for example the information be corrupted or lost during subsequent transmission, remote processing and/or display.

The provision of information visually is well known. In certain uses, such as, for example, in railway lineside signalling, the visual information which is provided is the primary means by which the driver of a rail vehicle can make a decision as to whether or not it is safe to proceed. As a result of this it is imperative that such visual information is presented in a failsafe manner so as to avoid potentially catastrophic errors from occurring.

Conventionally the information is provided in a manner which uses an element of mechanical or electrical operation to change the state of the information display. Typically the mechanical or electrical operation is only possible once a predetermined event or signal has been detected, which then allows the change in state to be performed. While this form of system has been used for many years, it does have several drawbacks, not least being the cost of upkeep of the apparatus. However, until now this form of system has been regarded as necessary in order to meet the stringent safety requirements.

The aim of the present invention is to provide apparatus and a method which allows information to be provided in a failsafe manner thereby meeting and typically exceeding the safety requirements, while at the same time providing a system which is more efficient and user friendly and less expensive to install and maintain.

In a first aspect of the invention there is provided apparatus for the provision of at least a first set of information, said apparatus including a control means and at least one display means, said control means located geographically remotely from the display means, communication means are provided between said control means and display means to allow the transmission of data between the same, said data which is transmitted to the display means being sufficient to allow a display to be generated which is representative of information to be shown to a viewer of the display means and wherein the control means is aware of the geographical location of the display means at the time of display and the data which is transmitted to the display means is dependent on the said geographical location at that time.

In one embodiment the known geographical location is within a predefined area or alternatively is a precise location.

In one embodiment data is transmitted from the display means and/or a further source to the control means which allows the geographical location of the display means to be determined. In one embodiment said data is GPS and/or inertial navigation unit (INU) data and/or is data indicative of a certain event occurring, such as, for example, an indicator at a known location having been reached and/or passed. In one embodiment the indicator is a tag or other detectable device, the presence of which can be detected as it is passed within a given range.

Typically the display means is provided to be movable and most typically is provided within a ground vehicle such as a train, car, bus or the like, or an aircraft taxiing on the ground.

In one embodiment the data which is transmitted is encrypted using a key which includes an identifier for the particular display means and/or vehicle in which the same is carried such that the data can only be used to generate a display on the particular display means for which it is provided.

In one embodiment the display is generated solely from the data transmitted to the control means.

In one embodiment, in addition to the display means, audible means are provided to be used in conjunction with the display means. In one embodiment the audible means are provided to be operated to generate an alert.

In one embodiment the data which is transmitted includes a second set of information which can be read at the location of the display means, so that the display means provides a first set of information and a second set of information which is assessed in conjunction with the first set. In one embodiment the display generated from the first set of information can only be generated and/or acted upon and/or retained when the criteria of the second set of information has been met. Typically the second set of information is assessed at the location of the display means and typically includes ensuring that the display of the second set of information meets predetermined criteria.

In one embodiment the second set of information relates to a time interval for which the display should be generated and can be provided in the form of an embedded machine-readable expiry timestamp for the generated display. This therefore avoids the possibility of a potentially wrong image still being displayed on the display screen as if the system is operating correctly the displayed image should always be removed and replaced before the expiry time is reached and, if this has not occurred, an alarm can be generated. In addition or alternatively the second set of information can include an embedded machine readable indication of the intended display colour of a predefined area of the display image. In addition or alternatively the second set of information can include an embedded machine-readable indication of the geographical location at which the current display should be shown and also, optionally, an indication of the geographical location at which it should be replaced with a new display. Again, if the geographical location of the display means is detected as having exceeded its geographic bounds of validity then an alarm can be generated. The apparatus therefore allows the generation of a display of information which is time and/or colour and/or geographical location sensitive, in a failsafe manner.

In one embodiment the second set of information is included within a barcode which is shown on the display and which can be read at the location of the display means by a barcode reader to identify the required information and then compare the same with the actual time and/or geographical location and/or image colour content at that instant. Typically the comparison is then repeated at given time intervals, or continuously until the time or location parameters are breached or the display changes Typically the data which is transmitted to the display means is encrypted, typically by using a suitable encryption method. In one embodiment the decryption of the data by the display means is only possible when the detected geographical location and/or local time and date matches that at which the display data is required to be viewed and used.

In one embodiment the display means is capable of generating an additional display or display icon which may be selectively generated upon the occurrence of a predefined event. Typically the additional display or display icon is generated locally to the display means, such as a partial overlay onto the first set of information, in response to a specific time or geographic location being reached or exceeded.

In one embodiment the apparatus is provided for use with a rail system in which the display means is located in the cab of the rail vehicle and the control means are provided, typically at the same location as the current rail control centres which control the movement of trains. In accordance with the invention the need for the provision of the mechanical or electrical lineside signals and the infrastructure for the same would be eliminated as the signal and the information to be provided by the same is "virtually" recreated on the display means within the train. As the geographical location of the train and the time of movement of the train can be identified, so the information feedback required by the control means and the driver of the train is still provided, thereby contributing to the failsafe nature of the apparatus.

Other possible uses of the apparatus in accordance with the invention are to provide the display means for use with regard to any or any combination of the display of road information; general public information; emergency signs; the display of medical information such as patient records, scans or the like; display of information for air travelers such as in relation to e-ticket and e-boarding pass information; failsafe display via a web browser and/or projected or video wall type displays and/or failsafe remote display of centrally generated mapping images.

In a further aspect of the invention there is provided a method of generating a display of information, said method comprising the steps of: identifying the geographical location of the display means on which the display is to be generated and the time at which the display is to be generated, identifying, at the control means, the display which is required to be generated for the said identified geographical location and/or time, transmitting a first set of data to the display means to allow the said display to be generated and wherein a second set of data is generated and transmitted, said second set of data including at least one parameter which is referred to in order to determine whether or not the said display should be shown.

In one embodiment the parameters include a geographical location and/or colour code and/or time.

In one embodiment if it is determined that the display should no longer be shown, but the same is still on screen, then an alarm is generated. In one embodiment the alarm may be such as to prevent further movement of a vehicle on which the display means is provided.

In one embodiment the data which is transmitted is encrypted using a key which includes an identifier for the particular display means such that only the identified display means is capable of decrypting the data.

In one embodiment, the second set of information is generated by the control means as a barcode embedded within the image corresponding to the first set of information as displayed at the display means, said barcode readable by apparatus at the display means so as to allow the expiry time and/or geographical information to be obtained. Typically the information which is obtained via the barcode is compared with real time data from a clock or GPS/INU which indicates the actual time and/or geographical location of the display means.

In one embodiment, the second set of information, typically displayed as a barcode, is augmented with one or more flashing or dynamically colour coded graphical cursors, added locally by the display means adjacent to the barcode section of the display. Provided that the barcode reader component of the display means is similarly augmented to allow it to also read back the displayed cursor(s) and determine their colour then it can rapidly and continuously confirm both the "liveness" and/or colour of operation of the local display and associated processing, without having to wait for a display image to expire.

A specific embodiment of the invention is now described with reference to the accompanying drawings wherein.

Figure 3A:
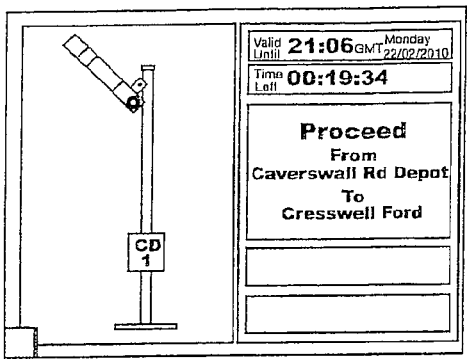
Figure 3B:
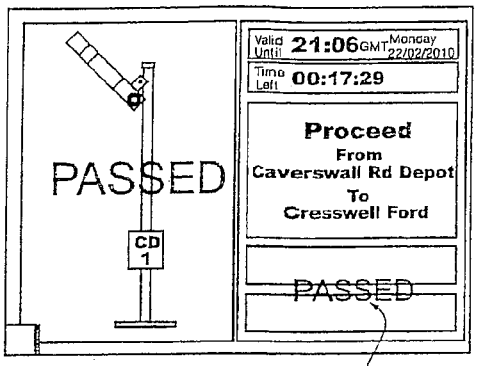
Figure 3C:
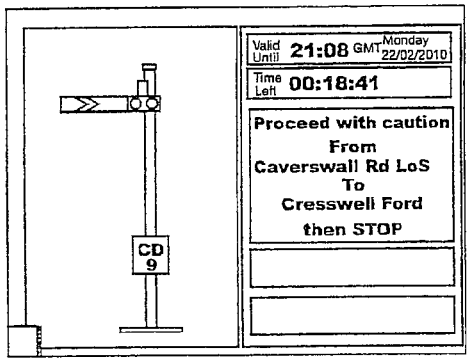
Figure 3D:
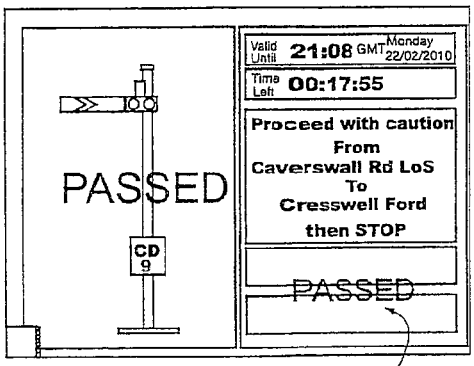
Figure 3E:
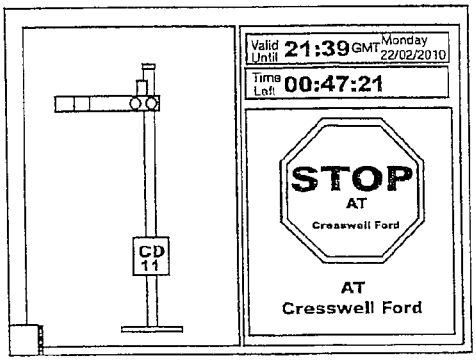
Figure 3F:
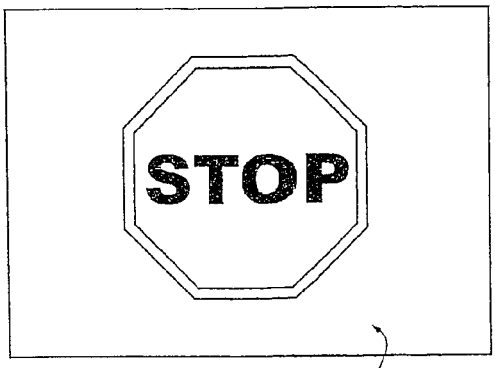
Figure 4:
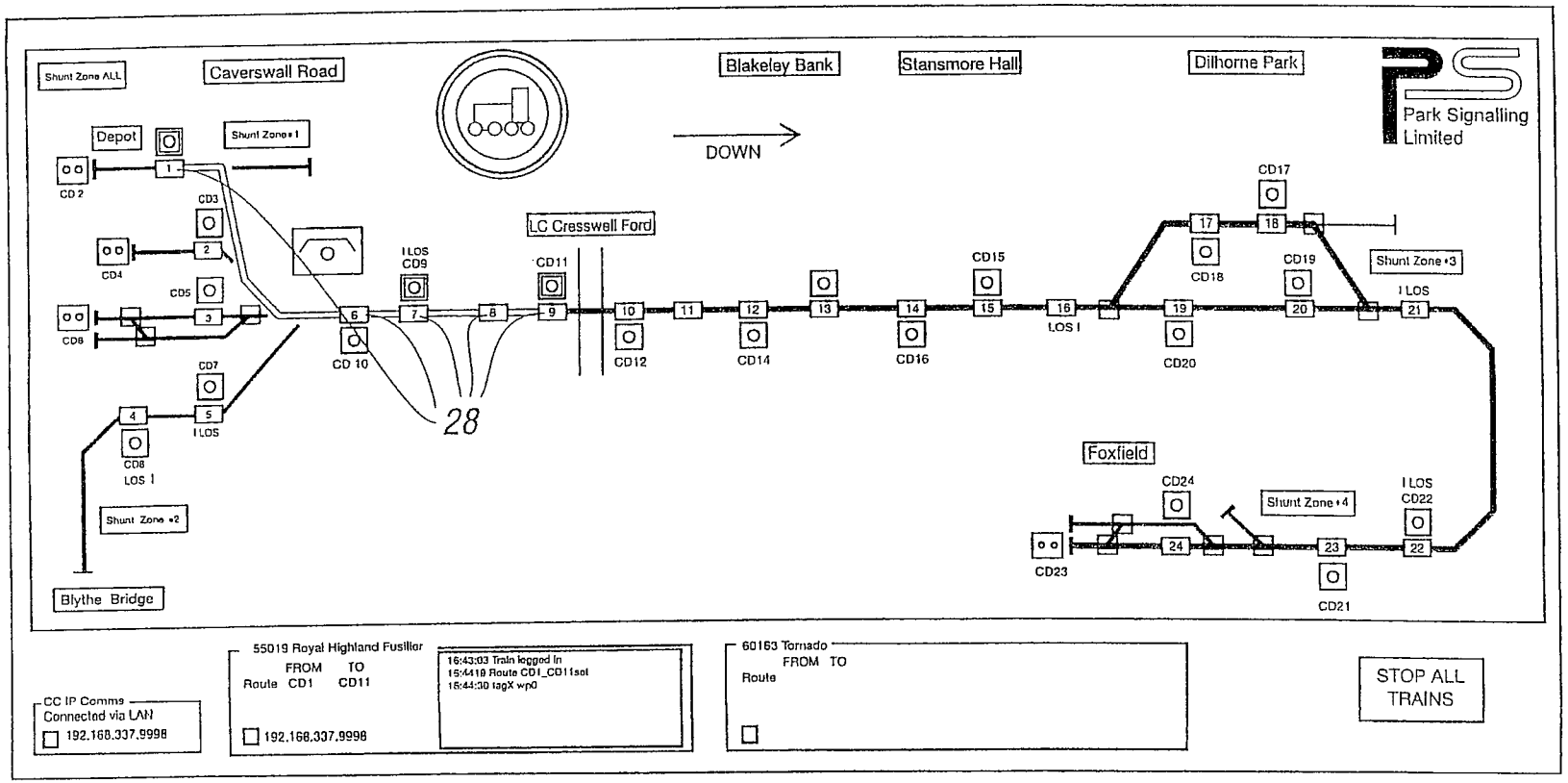

FIGS. 3*a-f* illustrate a range of displays which can be selectively created in accordance with one embodiment of the invention; and FIG. 4 illustrates a rail network which can utilise the system in accordance with one embodiment of the invention.

Figure 1:
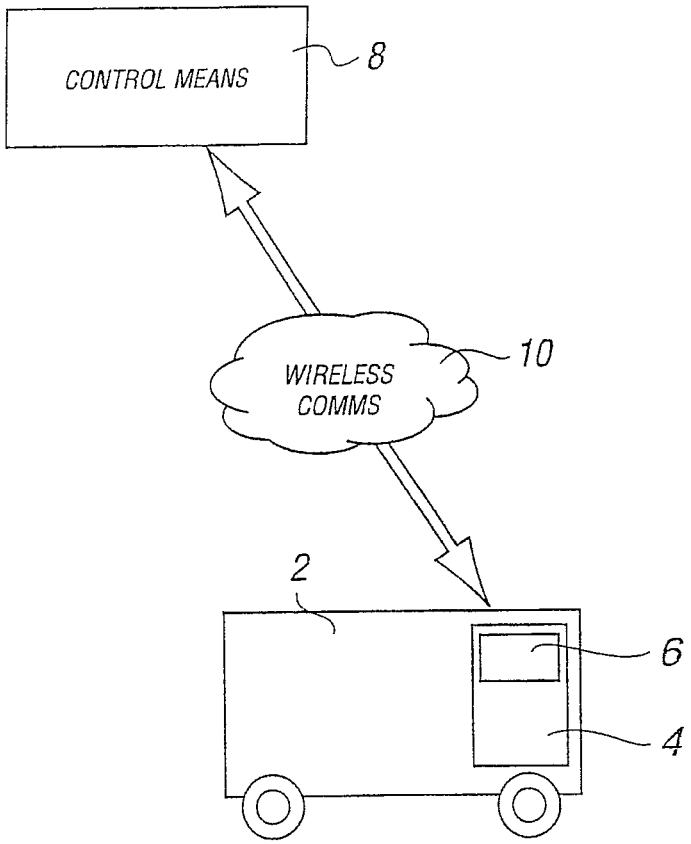
FIG. 1 illustrates schematically a system in accordance with one embodiment of the invention.

Referring firstly to FIG. 1 there is illustrated a system in accordance with the invention in a schematic manner. FIG. 1 illustrates a display means 4. The display means may be in a fixed position or, in the example shown, provided within a vehicle 2 which may be of any form for movement along roads, rail or the like. The vehicle includes therein the display means 4. The display means includes a display screen 6 which can be viewed by the operator of the vehicle and information shown thereon acted upon accordingly. A control means 8 is also shown, which is typically geographically remote from the vehicle 2. However the display means and control means are in wireless communication 10 which allows the transmission of data between the same. It should be appreciated that the control means 8 will typically be in communication with a number of display means at any given time and that each display means will have a unique network address and a unique set of encryption keys such that encrypted data which is transmitted to a specific display address may only be meaningfully recovered by the corresponding specific display means.

In accordance with the invention, the aim is to provide a display on the display means which can be used to impart information to one or more viewers, in a failsafe manner, thereby avoiding the possibility of the viewer acting on information which is factually incorrect at the time and/or location at which the same is being viewed.

Referring to FIG. 1 the control means 8 is aware of the geographical location of the display means 4, typically by data transmitted back to the control means 8 from the display means 4. The control means is also aware of the particular time and, with reference to these parameters, and possibly other external instructions and conditions can decide on the first set of information which is required to be shown on the display means screen 6 at that instant or a short time into the future. Data to allow the specific display to be generated at the intended display time is then transmitted from the control means to the display means 4 and subsequently decrypted and displayed on the display screen 6 to the viewer. The viewer, can then act accordingly on the basis of the first set of information displayed to them.

Typically the image data which is created at the control means for display on the display screen 6 of the display means 4 is achieved by using raster scanning techniques which reduces the risk of a correctly generated image being easily corrupted into a different, incorrect, but apparently correct image.

In addition to the first set of information, a second set of information is also generated and transmitted. The extent and type of information is dependent upon the operating environment of the display means, for example, whether it is in a fixed location or a moving location. However in either case the second set of information is provided to allow checks and references to be made so as to ensure that the image which has been generated is only displayed for a limited time or at a specific location, thereby preventing the occurrence of the freezing of the display from not being detected.

The invention is now described in one embodiment in which the same is used in conjunction with a rail system in order to allow the signalling controlling the passage of a train along the rail system to be depicted and informed to the driver of the train without the need for physical lineside signals and the infrastructure to cause the mechanical movement and/or electrical illumination of the same, to be provided.

Figure 2:
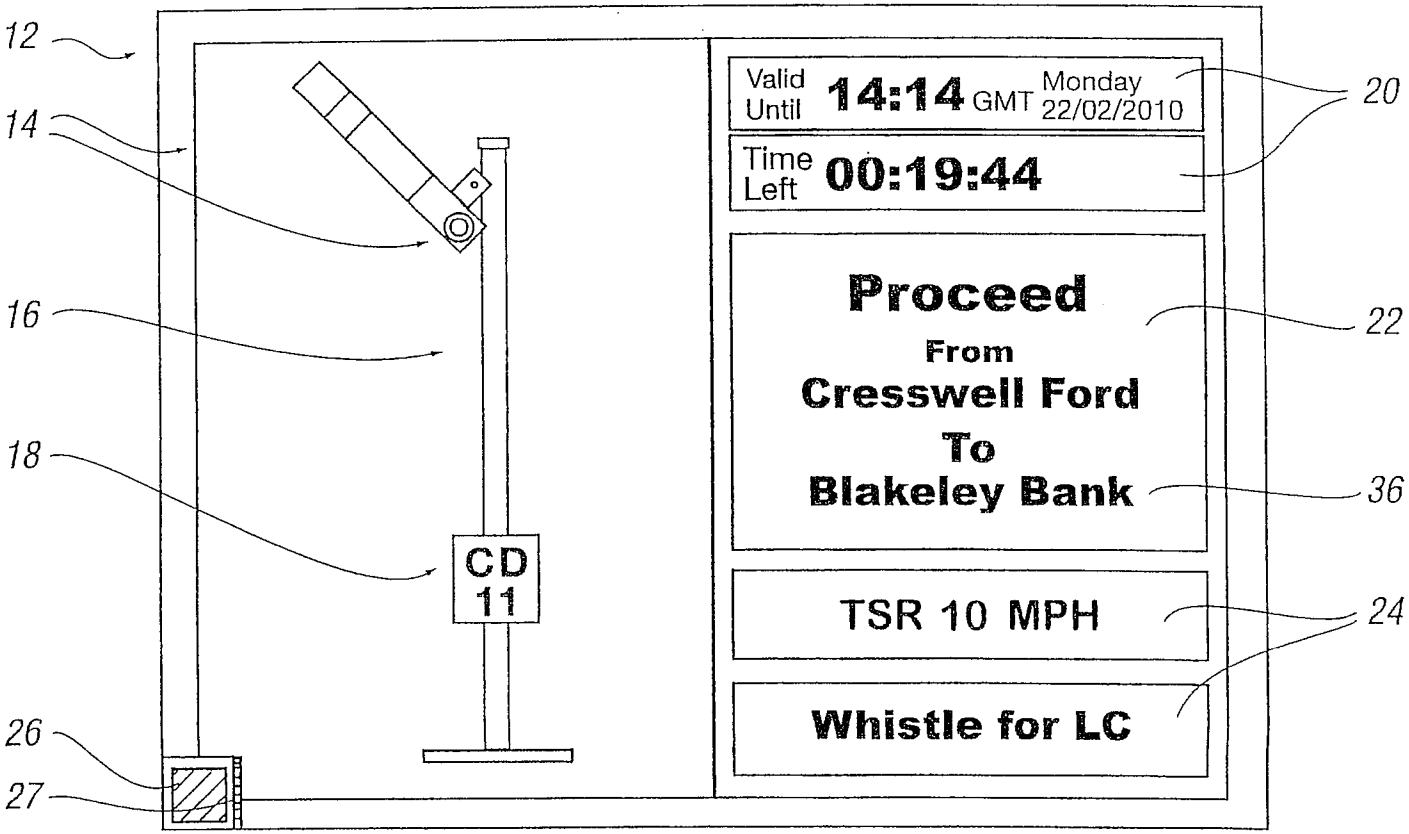
FIG. 2 illustrates a display screen in accordance with one embodiment of the invention.

With reference to FIG. 2 there is illustrated a display 12 of a type which can be generated on the display screen 6 of the display means in accordance with the invention. The display includes a signal state indication 14 in terms of green for proceed, yellow for proceed with caution and red for stop. A signal icon 16 can also be generated although it should be appreciated that this is more to meet with the expected appearance of a signal to the driver rather than any practical requirement for operation of the system. An identifier 18 for the particular signal depicted is also shown. In addition to this an expiry timestamp 20 is shown which indicates when the data and authority to move which is associated with the display will expire. The extent of the authority of movement along the track is indicated in box 22 and additional geographically localised warning or driver advisory information can be shown in box 24. Thus these components of the display 12 provide all the required aspects of the first set of information which the driver needs to have in order to proceed to move his/her train. The data is sent from the control means and therefore all that the display means needs to do is correctly decrypt and process the data to generate the display 12 and all the driver needs to do is interpret the information shown to them.

The information which is provided needs to be provided in a failsafe manner inasmuch that if there is an error caused by malfunction of the display means this needs to be identifiable at the display means' location. In order to achieve this, a second set of information is also shown by means of the barcode display 26 and colour bar 27. The display means will include means to interpret and use the information depicted by the barcode and colour bar.

In this example of use, the barcode includes information relating to the signal aspect colour, the expiry time up to which the display 12 remains valid and also the geographical location at which the display 12 should be shown. The display means is provided with a clock which allows the actual time to be compared with the expiry time encoded within the display 26. If the actual time exceeds that indicated by the display 26 then this indicates an error and so an alarm can be generated to prevent the driver using the information of the display 12 anymore. Equally, the display means can be provided with a GPS and/or internal navigation system, such that if the detected location of the display means is inconsistent with the geographical location indicated by the display 26, then again it is identified that the display 12 should no longer be shown and is in error and so the alarm is once more generated.

When the display means is stationary the information depicted by the display 26 may relate to the time of display only.

FIGS. 3*a-f* illustrate a series of displays which can be generated for the signalled route of a train along a short length of railway track within the track network illustrated in FIG. 4. FIG. 3*a* indicates the 'green entrance signal' display with the green 'proceed' light shown on the display at 14 and on the signal icon 16 which is generated and encrypted by the control means and transmitted to and decrypted and displayed by the display means at the start of the route to prompt the driver to move the train towards the location at which the first 'signal' is determined to be at as indicated in the 'From' field of movement authority display 22. When the train is detected as having, passed that location, typically by the train detecting a GPS/INU waypoint or an RFID tag on the track and transmitting data indicating this back to the control means, the display 12 is locally altered by the addition of a locally generated 'Passed' text 30 to that indicated in FIG. 3*b*. This scenario could then be repeated as necessary for subsequent intermediate 'green proceed signals' within the signalled route. When approaching the end of the route, as determined by detection of the appropriate waypoint or RFID tag code, the display changes to the 'yellow caution signal' shown in area 14 and signal icon 16 of FIG. 3*c*, based on data received at some point prior to that from the control means. This signal indicates that the driver should now proceed with caution until the end of the route, specifically 'red stop signal' CD11. As caution signal CD9 is reached and passed, the display is again locally augmented with the 'Passed' text 30, as indicated in FIG. 3*d*. Just prior to the end of the route, again as determined by detection of a specific waypoint or RFID tag code, the final set of encrypted image data from the control means is decrypted to allow the terminating, 'red exit signal' display of signal CD11 in FIG. 3*e* to be generated to indicate that the end of the route is being reached. In the operationally unauthorised event that the driver fails to stop at red signal. CD11 the 'STOP' alarm display 32 of FIG. 3*f* is locally generated by the display means, along with an audible alarm in the vehicle cab and an alarm report is sent to the control means. It should also be noted that in each case the border 14 of each of the displayed images in FIGS. 3*a-e* is coloured so that the intended signal 'aspect' colour is repeated across both the 'signal lamp' of the signal icon 16 and the image border and is thus also adjacent to the barcode section of the image.

In each case, apart from the 'STOP' alarm of FIG. 3*f*, the display 26 for the second, reference set of information is generated by the control means and displayed on the screen of the display means as shown, so as to ensure that no 'signal' display is still being displayed beyond the predetermined parameters.

FIG. 4 illustrates a railway signalling system in accordance with the invention for use with a relatively small railway track configuration. There are illustrated a highlighted series of signal or action location waypoints 28 corresponding to the setting of a specific signalled route within the system between the depot start waypoint which corresponds to the FIG. 3*a* display through to the Cresswell Ford waypoint corresponding to the destination section 36 of FIGS. 3*a-e*. Typically the control system generates data to be transmitted to the train as it passes along the track route, with data being generated for each of the waypoints 28 that it passes so that the driver is continuously informed of the current extent of their movement authority within the controlled area of railway until the destination 36 is reached. Thus it will be appreciated that the pair of 'proceed' displays shown in FIGS. 3*a* and 3*b* can be repeated for each corresponding pair of intermediate waypoints reached and passed by the train on the way to the destination 36, and that checks and appropriate displays will be generated as each waypoint is reached, detected and passed on the route.

There is therefore provided a system which allows the efficient and reliable display of information which is time sensitive and/or location sensitive in a failsafe manner.

The invention claimed is:

1. Apparatus for the provision of at least a first set of information, said apparatus including a control means and at least one display means, said control means located geographically remotely from the display means, communication means are provided between said control means and display means to allow the transmission of data between the same, said data which is transmitted to the display means being sufficient to allow a display to be generated which is representative of information to be shown to a viewer of the display means, the control means is aware of the geographical location of the display means at the time of display and the data which is transmitted to the display means is dependent on the geographical location of the display means at that time and characterised in that the data transmitted to the display means is encrypted, and decryption of the data by the display means is only possible when the detected geographical location or local time and date of the display means matches that at which the data for the display is required to be viewed and used, and further wherein the data which is transmitted includes a second set of information which can be read at the location of the display means, so that the display means provides a first set of information and a second set of information to be assessed in conjunction with the first set and a display generated from the first set of information can only be generated or acted upon or retained when the criteria of the second set of information has been met.

2. Apparatus according to claim 1 wherein the known geographical location is within a predefined area or along a predefined route.

3. Apparatus according to claim 1 wherein the geographical location is a precise location.

4. Apparatus according to claim 1 wherein data is transmitted from the display means or a further source to the control means which allows the geographical location of the display means to be determined.

5. Apparatus according to claim 4 wherein said data is GPS or inertial navigation unit (INU) data or is data indicative of a certain event occurring.

6. Apparatus according to claim 5 wherein the data is an indicator of a known location having been reached or passed.

7. Apparatus according to claim 6 wherein the indicator is a tag or other detectable device, the presence of which is detected as it is passed within a given range.

8. Apparatus according to claim 1 where the display means is movable.

9. Apparatus according to claim 8 wherein the display means is provided within a ground vehicle such as a train, car, bus or the like, or an aircraft taxiing on the ground.

10. Apparatus according to claim 1 wherein the data which is transmitted is encrypted using a key which includes an identifier for the particular display means or vehicle in which the same is carried and the data can only be used to generate a display on the particular display means to which it is intended to be provided.

11. Apparatus according to claim 1 wherein the display is generated solely from the data transmitted by the control means.

12. Apparatus according to claim 1 wherein in addition to the display means, audible means are provided to be used in conjunction with the display means.

13. Apparatus according to claim 1 wherein the second set of information is assessed at the location of the display means.

14. Apparatus according to claim 13 wherein the assessment includes ensuring that the display of the second set of information meets predetermined criteria.

15. Apparatus according to claim 1 wherein the second set of information relates to a time interval for which the display should be generated.

16. Apparatus according to claim 1 wherein the second set of information is in the form of an embedded machine-readable expiry timestamp for the generated display.

17. Apparatus according to claim 15 wherein if the display is still being displayed beyond the defined length of time, an alarm is generated.

18. Apparatus according to claim 1 wherein the second set of information includes an indication of the geographical location at which the displayed image should be shown.

19. Apparatus according to claim 1 wherein the second set of information includes an indication of the geographical location at which it should be replaced with a new display.

20. Apparatus according to claim 18 wherein if the geographical location of the display means is detected as having exceeded its geographic hounds of validity then an alarm is generated.

21. Apparatus according to claim 1 wherein the information relates to a particular colour of the display which should be being shown at that time on the display.

22. Apparatus according to claim 1 wherein the second set of information is included within a barcode which is shown on the display and which can be read at the location of the display means by a barcode reader to identify the required information and then compare the same with the actual time or geographical location at that instant.

23. Apparatus according to claim 1 wherein the assessment is repeated at predetermined time intervals, or continuously until the time or location parameters are breached or the display changes.

24. Apparatus according to claim 1 wherein the display means generates an additional display or display icon which is selectively generated upon the occurrence of a predefined event.

25. Apparatus according to claim 24 wherein the additional display or display icon is generated locally to the display means.

26. Apparatus according to claim 25 wherein the additional display or display icon is generated in response to a specific time or geographic location being reached or exceeded.

27. Apparatus according to claim 1 wherein the apparatus is provided for use with a rail system in which the display means is located in the cab of the rail vehicle and the control means are provided, typically at one or more rail control centres which control the movement of trains.

28. Apparatus according to claim 1 wherein the apparatus is provided for use with any or any combination of the display of road information; general public information; emergency signs; the display of medical information such as patient records, scans or the like; display of information for air travelers such as in relation to e-ticket and c-boarding pass information; failsafe display via a web browser or projected or video wall type displays or failsafe remote display of centrally generated mapping images.

29. A method of generating a display, said method comprising the steps of: identifying the geographical location of the display means on which the display is to be generated or the time at which the display is to be generated, identifying, at control means, the display which is required to be generated for the identified geographical location or time, transmitting a first set of data to the display means to allow the display to be generated and wherein a second set of data is generated and transmitted, said second set of data including at least one parameter which is referred to in order to determine whether or not the display should be shown characterised in that the data transmitted to the display means for display is encrypted and decryption of the data by the display means is only possible when the detected geographical location or local time and date of the display means matches that at which the display data is required to be viewed and used.

30. A method according to claim 29 wherein the parameter is a geographical location or time.

31. A method according to claim 29 wherein if it is determined that the display should no longer be shown, but the same is still on screen, an alarm is generated.

32. A method according to claim 31 wherein the alarm is such as to prevent further movement of a vehicle in which the display means is provided.

33. A method according to claim 29 wherein the data which is transmitted is encrypted using a key which includes an identifier for the particular display means such that only the identified display means is capable of decrypting the data.

34. A method according to claim 29 wherein the second set of information is generated by the control means as a barcode embedded within an image corresponding to the first set of information as displayed at the display means, said barcode readable by apparatus at the display means so as to allow an expiry time or geographical information to be obtained.

35. A method according to claim 34 wherein the information which is obtained via the barcode is compared with real time data from a clock or GPS/INU which indicates the actual time or geographical location of the display means.

36. A method according to claim 29 wherein the second set of information includes one or more flashing or dynamically coded graphical cursors, added locally by the display means adjacent to the barcode section of the display.

37. A method according to claim 36 wherein the display means can read back the displayed cursor(s) and determine their colour to confirm the "liveness" of operation or colour of the local display and associated processing.

* * * * *

UNITED STATES PATENT AND TRADEMARK OFFICE

CERTIFICATE OF CORRECTION

PATENT NO. : 8,988,251 B2
APPLICATION NO. : 13/287157
DATED : March 24, 2015
INVENTOR(S) : Benjamin Clements It is certified that error appears in the above-identified patent and that said Letters Patent is hereby corrected as shown below:

In the Claims

In column 8, line 27, please change “hounds” to --bounds--.

In column 8, line 62, please change “c-boarding” to --e-boarding--.

Signed and Sealed this
Seventh Day of July, 2015

Michelle K. Lee

Michelle K. Lee
*Director of the United States Patent and Trademark Office*